US007115171B2

(12) United States Patent
Powers et al.

(10) Patent No.: US 7,115,171 B2
(45) Date of Patent: Oct. 3, 2006

(54) METHOD FOR REMOVING ENGINE DEPOSITS FROM TURBINE COMPONENTS AND COMPOSITION FOR USE IN SAME

(75) Inventors: John Matthew Powers, Independence, KY (US); William Clarke Brooks, Lebanon, OH (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 11/020,291

(22) Filed: Dec. 27, 2004

(65) Prior Publication Data

US 2006/0137724 A1 Jun. 29, 2006

(51) Int. Cl.
*C23G 1/02* (2006.01)

(52) U.S. Cl. ..... 134/3; 134/2; 134/22.1; 134/22.16; 134/22.13; 134/22.17; 134/22.12; 134/22.19; 134/26; 134/28; 134/34; 134/36; 134/40; 134/41; 134/42

(58) Field of Classification Search ..... 134/22.1, 134/2, 3, 22.16, 22.17, 22.19, 26, 28, 34, 134/36, 40, 42, 41
See application file for complete search history.

(56) References Cited

U.S. PATENT DOCUMENTS 3,061,494 A 10/1962 Snyder et al.
3,085,917 A * 4/1963 Netzler et al. ..... 134/27
3,622,391 A * 11/1971 Baldi ..... 134/3
4,314,876 A 2/1982 Kremer et al.
4,327,134 A * 4/1982 Baldi ..... 427/253
4,525,250 A 6/1985 Fahrmbacher-Lutz et al.
4,900,398 A 2/1990 Chen
5,100,500 A 3/1992 Dastolfo et al.
5,126,005 A 6/1992 Blake
5,393,447 A 2/1995 Carlson et al.
5,417,819 A 5/1995 Askin et al.
5,723,078 A 3/1998 Nagaraj et al.
6,238,743 B1 * 5/2001 Brooks ..... 427/307
6,284,721 B1 9/2001 Lee
6,294,072 B1 9/2001 Fairbourn
6,407,047 B1 6/2002 Mehta et al.

(Continued)

OTHER PUBLICATIONS

"Material Safety Data Sheet," Turco Nitradd (T-4104), Henkel Surface Technologies.

(Continued)

*Primary Examiner*—Sharidan Carrillo
(74) *Attorney, Agent, or Firm*—Eric W. Guttag; Jagtiani & Guttag; Ted Cummings, Jr.

(57) ABSTRACT

A method and cleaning composition for removing engine deposits from turbine components, in particular turbine disks and turbine shafts. This method comprises the following steps: (a) providing a turbine component having a surface with engine deposits thereon, wherein the turbine component comprises a nickel and/or cobalt-containing base metal; and (b) treating the surface of the turbine component with a cleaning composition to convert the engine deposits thereon to a removable smut without substantially etching the base metal of the turbine component. The cleaning composition comprises an aqueous solution that is substantially free of acetic acid and comprising: a nitrate ion source in an amount, by weight of the nitrate ion, of from about 470 to about 710 grams/liter; and a bifluoride ion source in an amount, by weight of the bifluoride ion, of from about 0.5 to about 15 grams/liter. The smut that is formed can be removed from the surface of the turbine component in a manner that does not substantially alter the surface thereof.

14 Claims, 5 Drawing Sheets

U.S. PATENT DOCUMENTS

| | | | | |
|---|---|---|---|---|
| 6,440,224 | B1 | 8/2002 | Wei et al. | |
| 6,478,033 | B1 * | 11/2002 | Foster | 134/22.18 |
| 6,503,565 | B1 | 1/2003 | Hughes et al. | |
| 6,579,377 | B1 | 6/2003 | Wei et al. | |
| 6,579,439 | B1 | 6/2003 | Chandler | |
| 2001/0009246 | A1 * | 7/2001 | Zimmerman et al. | 216/34 |
| 2004/0045936 | A1 | 3/2004 | Davis et al. | |
| 2004/0065346 | A1 | 4/2004 | Wei et al. | |
| 2005/0161439 | A1 * | 7/2005 | Wustman et al. | 216/103 |
| 2005/0244274 | A1 * | 11/2005 | Wustman et al. | 416/241 R |

OTHER PUBLICATIONS

"Material Safety Data Sheet," CEE-BEE P-109E, McGean-Rohco, Inc.

* cited by examiner

METHOD FOR REMOVING ENGINE DEPOSITS FROM TURBINE COMPONENTS AND COMPOSITION FOR USE IN SAME

BACKGROUND OF THE INVENTION

This invention relates broadly to a method for removing engine deposits from turbine components, in particular turbine disks and shafts, using a cleaning composition. This invention further broadly relates to a cleaning composition for use in this method that comprises an aqueous solution comprising a nitrate ion source and a bifluoride ion source.

In an aircraft gas turbine engine, air is drawn into the front of the engine, compressed by a shaft-mounted compressor, and mixed with fuel. The mixture is burned, and the hot exhaust gases are passed through a turbine mounted on the same shaft. The flow of combustion gas turns the turbine by impingement against the airfoil section of the turbine blades, which turns the shaft and provides power to the compressor. The hot exhaust gases flow from the back of the engine, driving it and the aircraft forward. The hotter the combustion and exhaust gases, the more efficient is the operation of the jet engine. Thus, there is incentive to raise the combustion gas temperature.

The turbine engine includes turbine disks (sometimes termed "turbine rotors") and/or turbine shafts, a number of blades mounted to the turbine disks/shafts and extending radially outwardly therefrom into the gas flow path, and rotating, as well as static, seal elements that channel the airflow used for cooling certain components such as turbine blades and vanes. As the maximum operating temperature of the turbine engine increases, the turbine disks/shafts and seal elements are subjected to higher temperatures. As a result, oxidation and corrosion of the disks/shafts and seal elements have become of greater concern.

Turbine disks/shafts and seal elements for use at the highest operating temperatures are typically made of nickel and/or cobalt-base superalloys selected for good elevated temperature toughness and fatigue resistance. They have resistance to oxidation and corrosion damage, but that resistance is not sufficient to protect them at the operating temperatures now being reached. Over time, engine deposits, primarily in the form of nickel oxides and/or aluminum oxides, can form a coating or layer on the surface of these turbine components. These engine deposits typically need to be cleaned off or otherwise removed.

Accordingly, it would be desirable to be able be able to effectively and efficiently clean and remove engine deposits, especially engine deposits comprising metal oxides, from turbine components that comprise nickel and/or cobalt-containing base metals. It would be especially desirable to be able to clean and remove such engine deposits in a manner that does not excessively or substantially remove or alter the nickel and/or cobalt-containing base metal of the turbine component. It would further be desirable to be able to formulate a composition that is effective and efficient in cleaning and removing such engine deposits.

BRIEF DESCRIPTION OF THE INVENTION

This invention is broadly directed at a method comprising the following steps:

(a) providing a turbine component having a surface with engine deposits thereon, wherein the turbine component comprises a nickel and/or cobalt containing-base metal; and (b) treating the surface of the turbine component with a cleaning composition to convert the engine deposits thereon to a removable smut without substantially etching the base metal of the turbine component, wherein the cleaning composition comprises an aqueous solution that is substantially free of acetic acid and comprises:

a nitrate ion source in amount, by weight of the nitrate ion, of from about 470 to about 710 grams/liter; and a bifluoride ion source in amount, by weight of the bifluoride ion, of from about 0.5 to about 15 grams/liter.

This invention is further broadly directed at a composition comprising an aqueous solution that is substantially free of acetic acid and comprises:

a nitrate ion source in an amount, by weight of the nitrate ion, of from about 470 to about 710 grams/liter; and a bifluoride ion source in an amount, by weight of the bifluoride ion, of from about 0.5 to about 15 grams/liter.

The method and composition of this invention provides a number of significant benefits for removing such engine deposits from turbine components, especially turbine disks and turbines shafts, that comprise a nickel and/or cobalt-containing base metal. The method and composition of this invention effectively and efficiently remove such engine deposits from turbine components comprising nickel and/or cobalt-containing base metals within a reasonable period of time. The method and composition of this invention also remove such engine deposits in a manner that does not substantially remove or alter the nickel and/or cobalt-containing base metal of the turbine component.

DETAILED DESCRIPTION OF THE INVENTION

Figure 1:
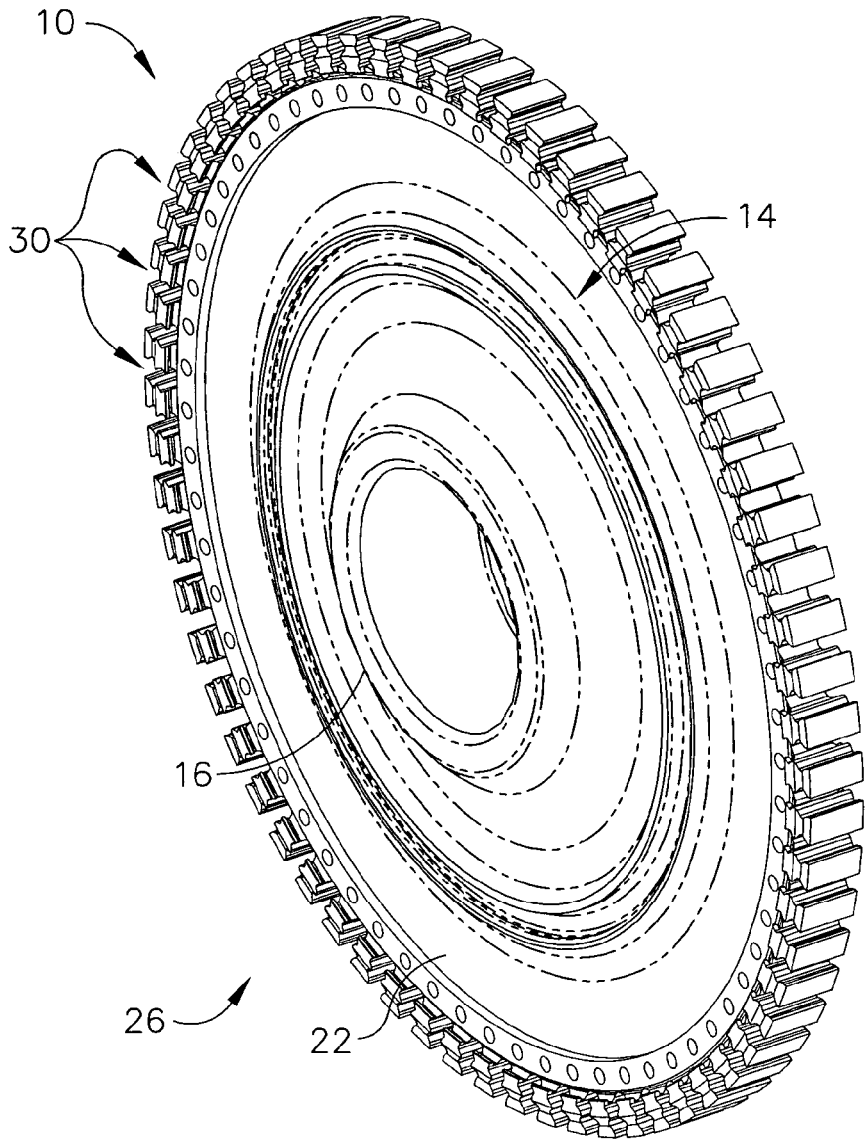
FIG. 1 is a representative turbine disk for which the composition and method of this invention is useful.

As used herein, the term "turbine component" refers to a wide variety of turbine engine (e.g., gas turbine engine) parts and components that comprise a nickel and/or cobalt-containing base metal, and which can have engine deposits formed on the surface thereof during normal engine operation that can require removal. These turbine engine parts and components can include turbine disks and shafts, turbine airfoils such as turbine blades and vanes, turbine shrouds, turbine nozzles, combustor components such as liners, deflectors and their respective dome assemblies, augmentor hardware of gas turbine engines, etc. The method and composition of this invention are particularly useful in removing engine deposits from the surfaces of turbine disks and turbine shafts.

As used herein, the term "nickel and/or cobalt-containing base metal" refers to a base metal that comprises nickel, cobalt, nickel and cobalt alloys, as well as alloys of nickel and/or cobalt with other metals such as iron, tungsten, molybdenum, chromium, manganese, titanium, aluminum, tantalum, niobium, zirconium, etc. Usually, the base metal comprises nickel and/or cobalt as the primary metal or metal alloy, typically in an amount of at least about 40% by weight, more typically in an amount of at least about 50% by weight. These nickel and/or cobalt base metals typically comprise nickel and/or cobalt superalloys that are disclosed in various references, such as, for example, commonly assigned U.S. Pat. No. 4,957,567 (Krueger et al), issued Sep. 18, 1990, and U.S. Pat. No. 6,521,175 (Mourer et al), issued Feb. 18, 2003, the relevant portions of which are incorporated by reference. Nickel and/or cobalt superalloys are also generally described in Kirk-Othmer's Encyclopedia of Chemical Technology, 3rd Ed., Vol. 12, pp. 417–479 (1980), and Vol. 15, pp. 787–800 (1981). Illustrative nickel and/or cobalt-containing base metal superalloys are designated by the trade names Inconel® (e.g., Inconel® 718), Nimonic®, Rene® (e.g., Rene® 88, Rene® 104 alloys), and Udimet®. For example, a base metal that can be used in making turbine disks and turbine shafts is a nickel superalloy available under the trade name Inconel® 718 that has a nominal composition, by weight, of 52.5% nickel, 19% chromium, 3% molybdenum, 3.5% manganese, 0.5% aluminum, 0.45% titanium, 5.1% combined tantalum and niobium, and 0.1% or less carbon, with the balance being iron.

As used herein, the term "engine deposits" refers to those deposits that form over time during the operation of a gas turbine engine as a coating, layer, crust, etc., on the surface of turbine component. These engine deposits typically comprise oxides of the base metal, for example, nickel oxides, cobalt oxides, etc., oxides of other metal contaminants, for example, aluminum oxides, etc., or combinations thereof.

As used herein, the term "smut" refers to the conversion product, composition, etc., that is removable from the surface of the turbine component and that is formed, generated, created, etc., when engine deposits on the surface of the turbine component are treated with the cleaning composition of this invention. This removable smut typically comprises oxides of the base metal, for example nickel oxides, cobalt oxides, etc, but may comprise other metal oxides, sodium salts, sulfur compounds, etc.

As used herein, the term "without substantially etching the base metal" means that there is minimal or no etching of the surface of base metal of the turbine component. This etching typically exhibits itself, when viewed under appropriate magnification (e.g., 1000×) as a corroding or pitting of or in the surface of the base metal of the turbine component, so as to form grooves, channels, crevices, etc., therein.

As used herein, the term "in a manner that does not substantially alter the surface thereof" means that there is about a 0.05 mil (1 micron) or less stock loss of the base metal from the surface of the turbine component.

As used herein, the term "stock loss" refers to a decrease in or loss of base metal from the surface of the turbine component.

As used herein, the term "substantially free of acetic acid" means that the composition comprises, at most, trace quantities of acetic acid, e.g., about 0.5% or less acetic acid, more typically about 0.1% or less acetic acid.

As used herein, the term "comprising" means the various compositions, compounds, components, steps, etc., can be conjointly employed in this invention. Accordingly, the term "comprising" encompasses the more restrictive terms "consisting essentially of" and "consisting of."

All amounts, parts, ratios, percentages, etc., used herein are by weight per volume unless otherwise specified.

This invention is based on the discovery that prior chemical methods of cleaning turbine engine components to remove engine deposits on the surface thereof often adversely affect or alter the properties of the base metal of the cleaned turbine component, especially when this turbine component comprises a nickel and/or cobalt-containing base metal. These prior chemical cleaning processes also usually have to be repeated several times and/or the chemically treated component requires excessively abrasive mechanical cleaning, for example, by aggressive grit blasting, to provide appropriate clean surface conditions for the turbine component. However, it has been found that excessive chemical cleaning increases the amount of processing time to achieve the desired surface conditions, while aggressive abrasive mechanical cleaning is labor intensive and requires great care to avoid excessive removal of the surface base metal that can alter the desired dimensional geometry of the turbine component.

This invention is further based on the discovery that prior chemical compositions that can be used to clean and remove engine deposits from the surface of the turbine component can also excessively etch the surface of the nickel and/or cobalt-containing base metals used in making the turbine component. Examples of such prior chemical etchant compositions are disclosed in U.S. Pat. No. 5,100,500 (Dastolfo et al), issued Mar. 31, 1992 (milling solution for titanium comprising ammonium bifluoride and hydrochloric acid); U.S. Pat. No. 4,314,876 (Kremer et al), issued Feb. 9, 1982 (titanium etching solution comprising ammonium bifluoride and a source of nitrate ions such as nitric acid). These prior chemical etchant compositions, when formulated at too high a bifluoride ion concentration, have been found to undesirably etch the surface of the turbine component and to remove excessive amounts of the nickel and/or cobalt-containing base metal therefrom, resulting in corroding or pitting of the base metal surface of the turbine component. In addition, it has found that chemical etchant compositions comprising acetic acid can cause undesired intergranular attack (i.e., at the grain boundaries) of the nickel and/or cobalt-containing base metal of the turbine component. Such intergranular attack can undesirably weaken the base metal at these grain boundaries.

The method and composition of this invention avoid the problems that can be caused by prior chemical methods, as well as prior chemical etchant compositions, in cleaning the surface of a turbine engine component comprising nickel and/or cobalt-containing base metals. The cleaning composition of this invention comprises an aqueous solution of a nitrate ion source (e.g., nitric acid) and a bifluoride ion source (e.g., ammonium bifluoride) in selected amounts that convert the engine deposits on the surface of the turbine component to a removable smut without substantially etching the surface of the turbine component comprising a nickel and/or cobalt-containing base metal. In particular, the cleaning compositions of this invention are substantially free of acetic acid that can cause undesired intergranular attack of a nickel and/or cobalt-containing base metal. The smut that is formed, generated, created, etc., by treatment with the cleaning composition of this invention can be subsequently and easily removed without the need of excessively abrasive mechanical treatment and without substantially altering the surface of the treated turbine component.

Figure 2:
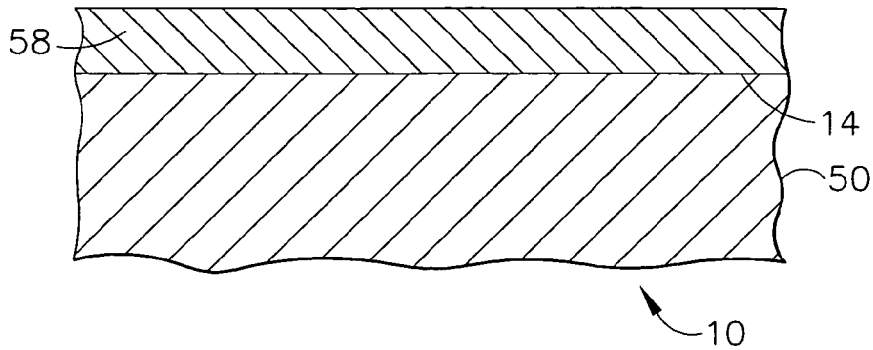
FIG. 2 is an enlarged sectional view of a portion of a turbine disk of FIG. 1 showing engine deposits on the surface thereof.
Figure 3:
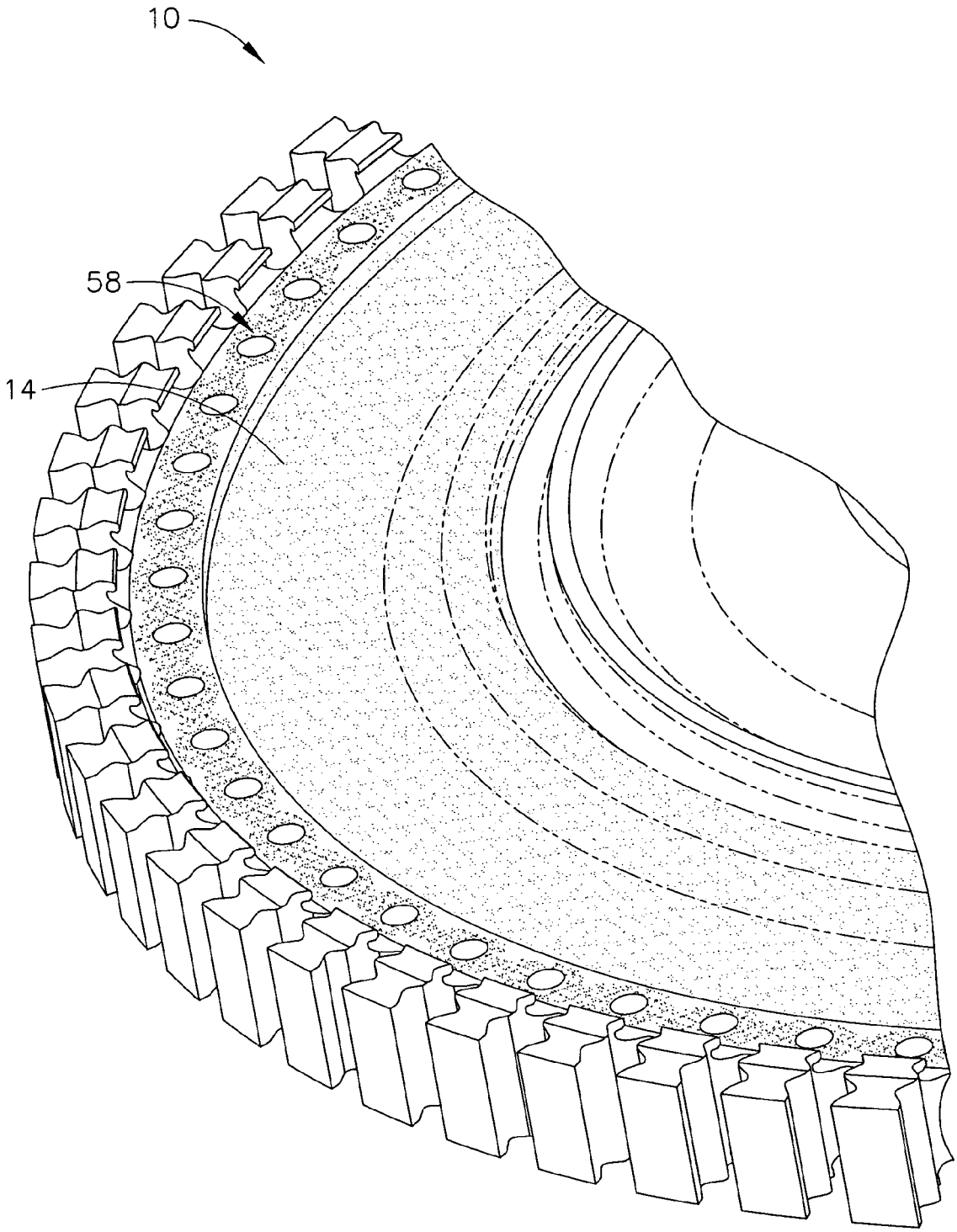
FIG. 3 is an illustration of a portion of a turbine disk of FIG. 1 having engine deposits on the surface thereof.
Figure 4:
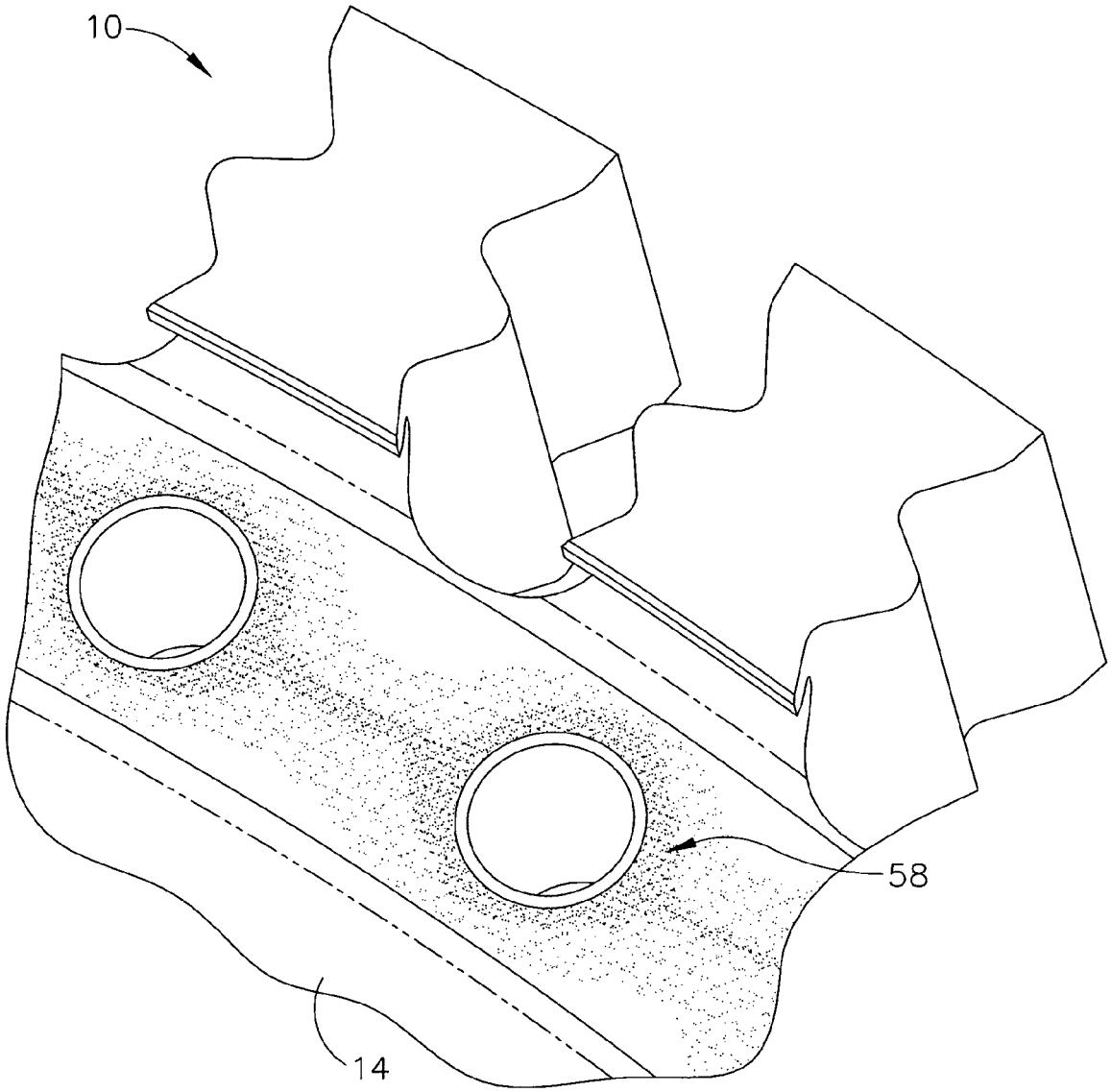
FIG. 4 shows an enlarged portion of the turbine disk of FIG. 3.

Referring to the drawings, FIG. 1 shows a representative turbine component for which the method and composition of this invention is useful in the form of a turbine disk indicated generally as 10 and having a surface indicated generally as 14. Disk 10 has an inner generally circular hub portion indicated as 18 and an outer generally circular perimeter or diameter indicated as 22, and a periphery indicated as 26 that is provided with a plurality of circumferentially spaced slots indicated as 30 that each receive the root portion of a turbine blade (not shown). FIG. 2 shows a sectional view of disk 10 of FIG. 1 comprising a base metal indicated as 50 having engine deposits indicated as 58 formed on surface 14. These engine deposits 58 tend to form on surface 14 of disk 10 in the area of hub portion 18 and outer diameter 22, and to a more limited extent in the proximity of periphery 26. FIG. 3 illustrates a turbine disk 10 having such engine deposits 58. These engine deposits 58 are particularly illustrated in an enlarged portion of this turbine disk 10 shown in FIG. 4, and typically appear as a dark or darker scale on the surface 14 of turbine disk 10.

In the method of this invention, the turbine component such as turbine disk 10 having engine deposits 58 on surface 14 thereof is treated with a cleaning composition of this invention. This cleaning composition comprises an aqueous solution that is substantially free of acetic acid and comprises: a nitrate ion source in an amount, by weight of the nitrate ion, of from about 470 to about 710 grams/liter, typically from about 565 to about 665 grams/liter; and a bifluoride ion source in amount, by weight of the bifluoride ion, of from about 0.5 to about 15 grams/liter, typically from about 5 to about 10 grams/liter. Suitable sources of nitrate ion include nitric acid, sodium nitrate, potassium nitrate, ammonium nitrate, etc., as well as combinations thereof. Typically, the nitrate ion source comprises nitric acid. Suitable sources of bifluoride ion include ammonium bifluoride, sodium bifluoride, potassium bifluoride, etc., as well as combinations thereof. Typically, the bifluoride ion source comprises ammonium bifluoride. The cleaning composition can also comprise other optional components such as non-acetic acid buffers, wetting agents (e.g., surfactants), etc.

The surface 14 of turbine disk 10 having the engine deposits 58 thereon can be treated with the cleaning composition of this invention in any suitable manner and for a period of time sufficient to: (1) convert or substantially convert engine deposits 58 on the surface 14 of disk 10 to a removable smut; (2) without substantially etching base metal 50 of disk 10. Treatment can be carried out on surface 14 of turbine disk 10 by brushing, roller coating, flow coating, pouring or spraying the cleaning composition on surface 14, by soaking, dipping or immersing surface 14 with or in the cleaning composition, etc. Typically, treatment is carried out by soaking surface 14 of turbine disk 10 with, or immersing surface 14 of turbine disk 10 in, the cleaning composition. Treatment with the cleaning composition is typically carried out for a period of from about 1 to about 10 minutes, more typically for a period of from about 3 to about 7 minutes. Treatment can be carried out at room temperature (e.g., from about 20° to about 25° C.), or at more elevated temperatures. Surface 14 of disk 10 can be subjected to other pretreatment steps prior to cleaning with the cleaning composition. For example, the surface 14 of disk 10 can be pretreated to remove or breakdown any oily or other carbonaceous deposits, to aid in the breakdown or removal of any engine deposits 58 thereon by subsequent treatment with the cleaning composition of this invention, etc. For example, surface 14 can be pretreated with an alkaline degreaser composition such as sodium hydroxide.

To protect other portions of turbine disk 10 that do not require cleaning, maskants that are relatively chemically resistant or inert to the components of the cleaning composition can be applied to those portions of disk 10 that do not require cleaning. Suitable maskants include plastic films, coatings, or other materials that can be applied to the metal surface(s) and that are made from polymers, compounds or other compositions that are chemically resistant or inert to the components of the cleaning composition of this invention, such as ethylene glycol monomethyl ether-based compositions, rubber or synthetic rubber compositions such as neoprene-based polymers, and polytetrafluoroethylene. See, for example, U.S. Pat. No. 5,126,005 (Blake), issued Jun. 30, 1992 (especially col. 2, lines 8–34); U.S. Pat. No. 5,100,500 (Dastolfo), issued Mar. 31, 1992 (especially col. 5, lines 49–63); and U.S. Pat. No. 4,900,389 (Chen), issued Feb. 13, 1990 (especially col. 2, lines 46–51), the relevant portions of which are incorporated by reference. The maskant can be applied in any conventional manner to the portion(s) of disk 10 to be protected from the cleaning composition, including brushing, dipping, spraying, roller coating or flow coating. Once treatment with the cleaning composition has been carried out, the maskant can then be removed from disk 10.

After treatment of turbine disk 10 with the cleaning composition of this invention, any residue thereof on surface 14 of disk 10 can be rinsed off (e.g., with water), neutralized or otherwise removed by methods known to those skilled in the art. Typically, disk 10 is immersed in water, followed by a high pressure water rinse and drying thereof to remove any of the residual cleaning composition from surface 14. Alternatively, treatment of disk 10 with the cleaning composition can be halted periodically (e.g., every from about 3 to about 5 minutes), with the residual cleaning composition on surface 14 of disk 10 being rinsed off and/or neutralized. Any maskant that is applied to disk 10 can also be removed, such as by stripping from the surfaces (with or without treatment with solvents for the maskant) or other methods known to those skilled in the art, so that disk 10 can be ready for return to use.

Figure 5:
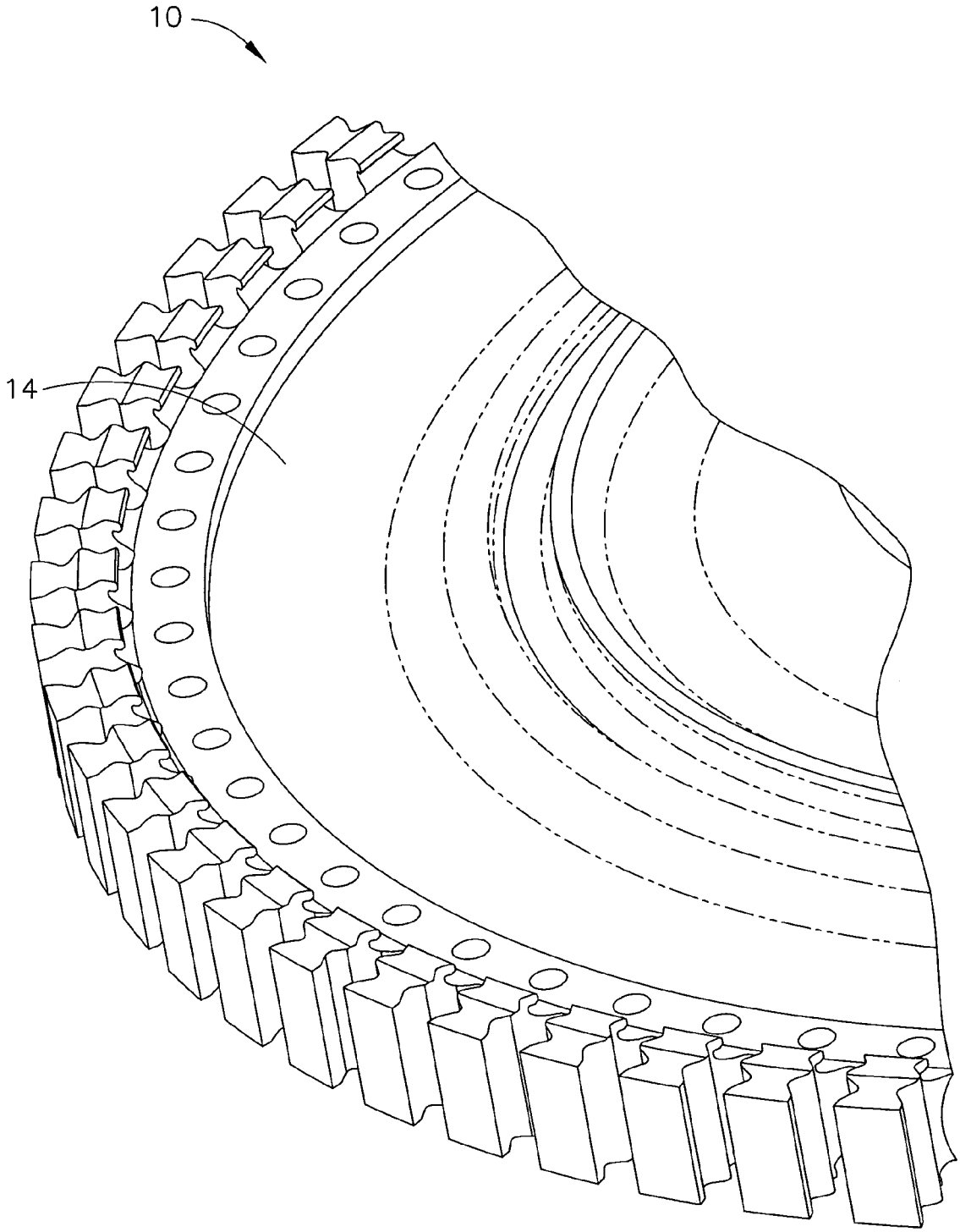
FIG. 5 is an illustration of a portion of the turbine disk of FIG. 1 after cleaning by an embodiment of the composition and method of this invention.

The treatment of turbine disk 10 with the cleaning composition of this invention typically forms or generates a relatively thin residue film, layer, etc., of a removable smut on the treated surface 14 of disk 10. This smut that is formed can be removed or substantially removed from surface 14 of disk 10 in any manner that does not substantially alter surface 14 of disk 10. For example, this smut layer or film can be removed by conventional methods known to those skilled in the art for gently removing similar smut layers or films. Suitable removal methods include relatively gentle grit blasting, with or without masking of surfaces that are not to be subjected to grit blasting. See U.S. Pat. No. 5,723,078 to Nagaraj et al, issued Mar. 3, 1998, especially col. 4, line 46–67 to col. 5, line 3 and 14–17, the relevant portions of which are incorporated by reference. The turbine disk 10, after treatment with a cleaning composition of this invention, and after removal of the smut that is formed, is typically substantially free of engine deposits, i.e., there is no visible dark or darker scale on surface 14. See FIG. 5 which shows turbine disk 10 to be substantially free of engine deposits 58 after cleaning of surface 14 with the cleaning composition of this invention using the method of this invention.

Figure 6:
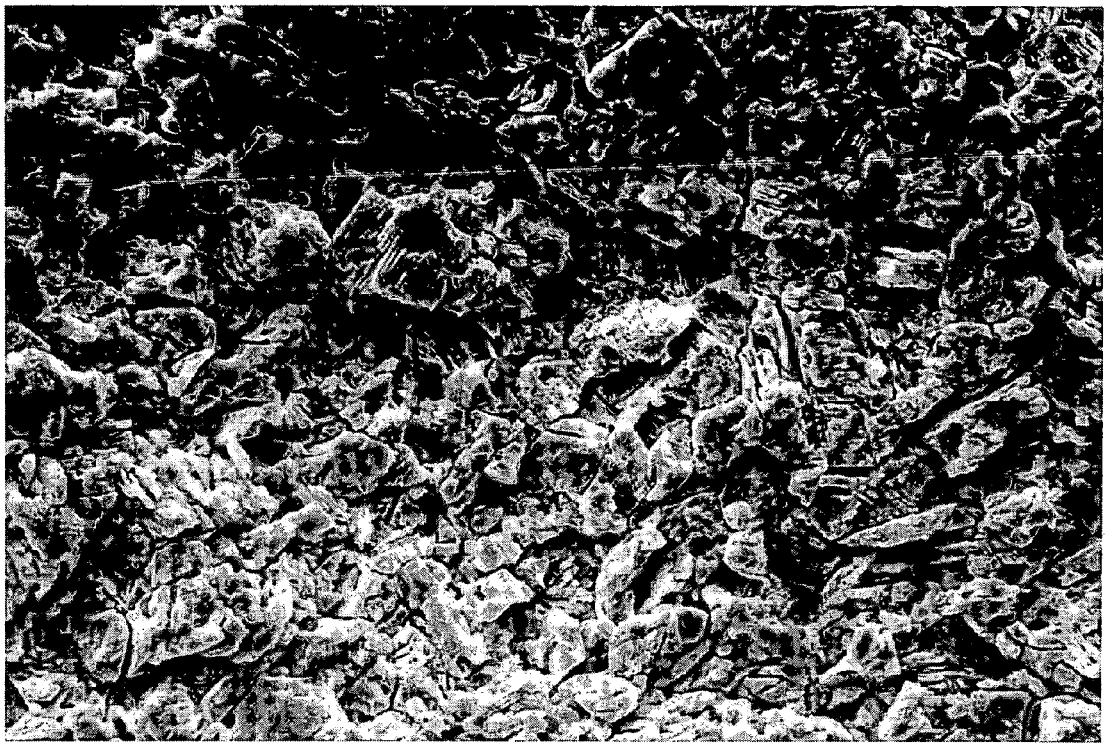
FIG. 6 is a magnified image (1000×) showing excessive etching of the surface of the base metal of a turbine component when treated for too long with a solution formulated with too low a concentration of nitrate ion and too high a concentration of bifluoride ion.

The components or materials that comprise the cleaning composition of this invention (e.g., nitric acid and ammonium bifluoride) are potentially etchants for the nickel and/or cobalt-containing base metal, and can therefore cause excessive etching of the base metal of the turbine component, especially if the nitrate ion concentration is too low (i.e., below about 470 grams/liter), the bifluoride ion concentration is too high (i.e., above about 15 grams/liter) and the base metal surface is treated with the cleaning composition for too long a period of time (e.g., above about 10 minutes). This potential for excessive etching of the nickel and/or cobalt-containing base metal surface is illustrated by FIG. 6 that shows the magnified image of a turbine component surface treated for 30 minutes with a solution formulated with nitric acid to provide a nitrate ion concentration below about 470 grams/liter, and a commercially available ammonium bifluoride product (i.e., Turco 4104 that further comprises acetic acid) to provide a bifluoride ion concentration above about 15 grams/liter. As can be seen in FIG. 6, the nickel and/or cobalt-containing base metal surface is extremely pitted and corroded in appearance, indicating excessive etching of the base metal surface by this solution.

While specific embodiments of this invention have been described, it will be apparent to those skilled in the art that various modifications thereto can be made without departing from the spirit and scope of this invention as defined in the appended claims.

What is claimed is:

1. A method comprising the following steps:

(a) providing a turbine component having a surface with engine deposits formed thereon during operation of a gas turbine engine, wherein the turbine component comprises a nickel and/or cobalt-containing base metal; and (b) treating the surface of the turbine component with a cleaning composition to convert the engine deposits thereon to a removable smut without substantially etching the base metal of the turbine component, wherein the cleaning composition comprises an aqueous solution that is substantially free of acetic acid and comprises:

a nitrate ion source in an amount, by weight of the nitrate ion, of from about 470 to about 710 grams/liter; and a bifluoride ion source in an amount, by weight of the bifluoride ion, of from about 0.5 to about 15 grams/liter.

2. The method of claim 1 wherein the cleaning composition comprises the nitrate ion source in an amount, by weight of the nitrate ion, of from about 565 to about 665 grams/liter; and the bifluoride ion source in an amount, by weight of the bifluoride ion, of from about 5 to about 10 grams/liter.

3. The method of claim 1 wherein the nitrate ion source comprises nitric acid, sodium nitrate, potassium nitrate, ammonium nitrate, or combinations thereof.

4. The method of claim 1 wherein the bifluoride ion source comprises ammonium bifluoride, sodium bifluoride, potassium bifluoride, or combinations thereof.

5. The method of claim 1 wherein step (b) is carried out by treating the surface of the turbine component with the cleaning composition for a period of from about 1 to about 10 minutes.

6. The method of claim 3 wherein the nitrate ion source comprises nitric acid.

7. The method of claim 4 wherein the bifluoride ion source comprises ammonium bifluoride.

8. The method of claim 5 wherein step (b) is carried out by treating the surface of the turbine component with the cleaning composition for a period of from about 3 to about 7 minutes.

9. The method of claim 5 wherein step (b) is carried out by immersing the turbine component in the cleaning composition or by soaking the turbine component with the cleaning composition.

10. A method comprising the following steps:

(a) providing a turbine component that is a turbine disk or turbine shaft, the turbine component having a surface and comprising a nickel and/or cobalt-containing base metal; and (b) treating the surface of the turbine component with a cleaning composition for a period of from about 1 to about 10 minutes and sufficient to convert engine deposits formed on the surface during operation of a gas turbine engine to a removable smut without substantially etching the base metal of the turbine component, wherein the cleaning composition comprises an aqueous solution that is substantially free of acetic acid and comprises:

a nitrate ion source in an amount, by weight of the nitrate ion, of from about 470 to about 710 grams/liter; and a bifluoride ion source in an amount, by weight of the bifluoride ion, of from about 0.5 to about 15 grams/liter; and (c) removing the smut from the treated surface of the turbine component in a manner that does not substantially alter the surface thereof.

11. The method of claim 10 wherein step (b) is carried out by immersing the turbine component in the cleaning composition or by soaking the turbine component with the cleaning composition.

12. The method of claim 10 wherein the cleaning composition comprises nitric acid in an amount, by weight of the nitrate ion, of from about 565 to about 665 grams/liter; and ammonium bifluoride in amount, by weight of the bifluoride ion, of from about 5 to about 10 grams/liter.

13. The method of claim 10 wherein step (c) is carried out by gently grit blasting the surface of the turbine component to remove the smut.

14. The method of claim 10 wherein step (b) is carried out by treating the surface of the turbine component with the cleaning composition for a period of from about 3 to about 7 minutes.

* * * * *